United States Patent [19]

Taipale

[11] 4,167,864

[45] Sep. 18, 1979

[54] MEANS OF IMPROVING GEAR LIFE

[75] Inventor: Dale L. Taipale, Libertyville, Ill.

[73] Assignee: Outboard Marine Corporation, Waukegan, Ill.

[21] Appl. No.: 914,873

[22] Filed: Jun. 12, 1978

[51] Int. Cl.[2] ..... C21D 7/06

[52] U.S. Cl. ..... 72/53

[58] Field of Search ..... 72/53; 51/319, 320, 51/321

[56] References Cited

U.S. PATENT DOCUMENTS

| | | | |
|---|---|---|---|
| 1,585,989 | 5/1926 | Higginson | 29/404 |
| 2,542,955 | 2/1951 | Young | 72/53 |
| 3,073,022 | 1/1963 | Bush | 72/53 |
| 4,034,585 | 7/1977 | Straub | 72/53 |

*Primary Examiner*—Carl E. Hall
*Assistant Examiner*—Gene P. Crosby
*Attorney, Agent, or Firm*—Michael, Best & Friedrich

[57] ABSTRACT

Disclosed herein is a process of compression stressing a metal workpiece having a body with a central bore so as to produce a residual compressive stress in the workpiece to increase the fatigue strength of the workpiece. The process includes the steps of forcing the workpiece onto a mandrel to induce an initial tensile stress in the body, thereafter inducing a compressive stress in the surface of the workpiece by shot blast treatment of the surface of the workpiece, and thereafter separating the workpiece from the mandrel to increase the compressive stress in the surface of the workpiece.

5 Claims, 3 Drawing Figures

MEANS OF IMPROVING GEAR LIFE

BACKGROUND OF THE INVENTION

The invention relates generally to a process of producing residual compressive stress in the surface of a metal workpiece to increase its fatigue strength, and more particularly to a method of producing a residual compressive stress in the external surface of a metal workpiece by forcing the workpiece onto a mandrel to induce a tensile stress in the workpiece and thereafter inducing a compressive stress in the surface of the workpiece by shot blast treatment.

A process of compression stressing metals to increase the fatigue strength thereof by shot-peening is described in U.S. Straub Pat. No. 4,034,585, issued July 12, 1977. The process described therein discloses a process for improving the fatigue strength of metal parts by two sequential shot-peening processes.

U.S. Pat. No. 3,073,022 issued Jan. 15, 1963 similarly shows a method for compression stressing a metal workpiece by subjecting the workpiece to a first shot-peening step using large shot directed at high intensity against the workpiece and then subjecting the workpiece to a second shot-peening step using smaller shot and at a lower intensity.

The U.S. Young et al. Pat. No. 2,542,955 issued Feb. 20, 1951 discloses an apparatus for use in supporting a workpiece to be shot-peened, the apparatus including means for rotating the workpiece.

Attention is also directed to U.S. Pat. No. 1,585,989 issued May 25, 1926 which discloses a method for making spinning rings, the method including the steps of forcing the spinning ring onto a circular mandrel to make the ring circular and thereafter grinding the exterior surface of the ring. Attention is further directed to U.S. Pat. No. 3,210,837 issued Oct. 12, 1965.

SUMMARY OF THE INVENTION

The invention includes a process of compression stressing a metal workpiece having a body with a central bore so as to produce a residual compressive stress in the workpiece to increase the fatigue strength of the workpiece. The process includes the steps of forcing the workpiece onto a mandrel to induce an initial tensile stress in the body, thereafter inducing a compressive stress in the workpiece by shot blast treatment of the surface of the workpiece, and thereafter separating the workpiece from the mandrel to increase the compressive stress in the workpiece.

The invention also provides a method of compression stressing a gear including a circumferential body having a central bore and peripheral circumferentially spaced gear teeth and for producing a residual compressive stress in the body of the gear to increase the fatigue strength of the gear. The method includes the steps of forcing the gear onto a tapered circular mandrel so that the bore of the gear is made circular and a tensile stress is applied to the circumferential body of the gear, thereafter shot-peening the surface of the gear to induce a compressive stress in the circumferential body of the gear, and thereafter removing the gear from the tapered mandrel so as to relieve the tensile stress in the gear and to increase the compressive stress in the gear and so as to produce a residual compressive stress in the workpiece greater than the compressive stress induced by the shot blast treatment by an amount proportional to the initial tensile stress.

Other features and advantages of the embodiments of the invention will become apparent to those skilled in the art upon reviewing the following detailed description, the drawings and the appended claims.

Figure 1:
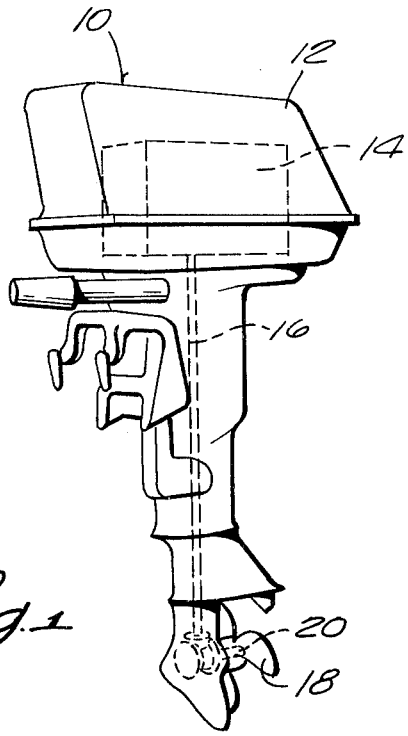
FIG. 1 is a perspective view of an outboard motor including a gear shot-peened in accordance with the present invention.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENT

An outboard motor 10 is shown in FIG. 1 as including a housing 12 encasing an engine 14. The engine drives a downwardly extending drive shaft 16. The drive shaft 16 is functional to rotatably drive a propeller 18 supported on an output shaft 20.

Figure 2:
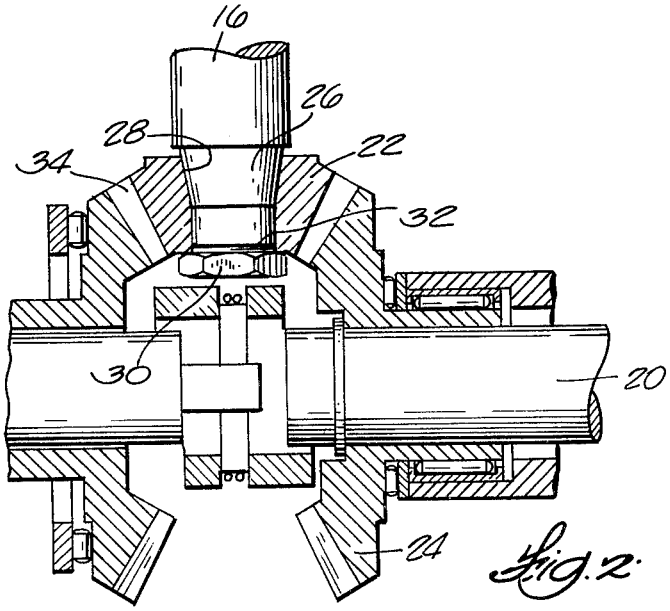
FIG. 2 is an enlarged cross-section view of a portion of the drive mechanism of the outboard motor shown in FIG. 1.

Referring to FIG. 2, a drive pinion gear 22 is shown positioned on the lower end of the drive shaft 16 and functions to drive a driven pinion gear 24 in turn driving the output shaft 20. The drive shaft 16 includes a tapered end 26 for receiving the drive pinion 22. The drive pinion 22 includes a central tapered bore 28, the taper of the bore 28 being complementary to the taper of the tapered end 26 of the drive shaft 16, and the pinion 22 is mounted on the drive shaft 16 such that an interference fit exists between the drive shaft 16 and the drive pinion 22. The drive pinion 22 is retained on the drive shaft 16 by a nut 30 threadably mounted on a threaded end 32 of the drive shaft 16.

During assembly of the drive pinion 22 onto the drive shaft 16, torque applied to the nut 30 causes the pinion to be forced onto the tapered end 26 of the drive shaft 16. As the pinion moves along the tapered end 26 of the drive shaft 16, it is forced to conform to the cross-sectional contour of the drive shaft and then to move along the taper of the drive shaft such that an interference fit is accomplished. This seating causes tensile stresses to occur in the circumferential body of the pinion. Such tensile stresses are particularly acute at the roots of the gear teeth 34 of the pinion 22.

Failure of gears commonly results from fatigue failure of the gear teeth at the roots of the gear teeth, and such fatigue failure occurs if the net resultant tensile stresses applied to the surface of the metal of the gear at the roots of the gear teeth is greater than the fatigue strength of the gear metal at that surface. Fatigue failure is a brittle failure commonly beginning as a crack formed in the surface of a part as a result of the application of a tensile stress in that surface. Propagation of the crack and ultimate fatigue failure may then result from the application of repeated cycles of tensile stress occurring, for example, at the roots of the teeth 34 of the pinion 22 when the pinion 22 drives the driven pinion 24.

If a residual compressive stress exists in the surface of the part, the net resultant tensile stress occurring in the surface of the part is the algebraic sum of the tensile stress applied to the surface of the part and the residual compressive stress pre-existing in the part. Since fatigue failure propagation begins as the result of a tensile stress in the surface of a part, fatigue failure can be prevented by producing a residual compressive stress at the surface of the part to thereby reduce the magnitude of a resultant tensile stress therein. Accordingly, the resistance of the pinion 22 to fatigue failure can be increased by processing the pinion 22 to produce residual compressive stresses in the surface of the pinion metal, and particularly at the surface of the metal at the roots of the gear teeth. It is particularly desirable to produce high residual compressive stresses in workpieces such as pinion 22 because the pinion 22 is subjected to a combination of tensile stresses including an initial tensile stress induced in the part during assembly when the pinion 22 is forced onto the tapered end 26 of the drive shaft 16 and additional tensile stresses applied to the pinion 22 when the pinion 22 drives pinion 24.

As taught in U.S. Pat. Nos. 3,034,585 and 3,073,022, cited above, shot-peening the surface of a metal part is effective to produce a residual compressive stress in the surface of the part to thereby improve the fatigue strength of the part, i.e., to improve the resistance of the surface of the part to tensile stresses However, a workpiece can normally sustain only a limited residual compressive stress. Additional compressive stress applied to the part, if greater than the yield strength of the material of the part, results in plastic deformation of that material. On the other hand, the quantitative compressive stress which can be achieved by a shot-peening process is restricted by the size of the shot, the velocity of the shot, and the hardness of the shot. When shot-peening workpieces such as gears, the shot size is limited by the dimensions between the gear teeth and the radii of curvature at the roots of the gear teeth. Using common shot-peening equipment and using conventional steel shot, the limit of the residual compressive stress which can be induced in a workpiece such as pinion 22 is normally higher than the compressive stress which can be obtained by shot peening. Accordingly, it is frequently desirable that means be provided for further increasing the residual compressive stress obtained in the surface of a workpiece such as pinion 22.

Figure 3:
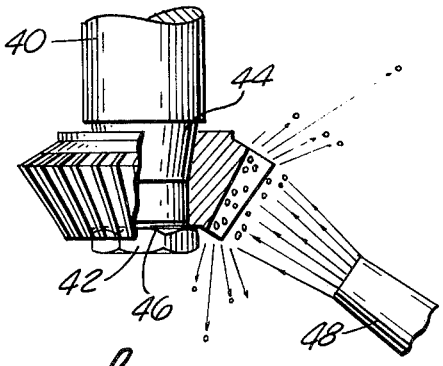
FIG. 3 is a perspective view of the gear shown in FIG. 2 mounted on a mandrel and being shot-peened in accordance with the present invention and with a portion of the gear broken away.

Using the process of the invention, the resultant residual compressive stress which can be achieved in a workpiece such as a gear using conventional equipment is increased. Using the process of the invention, the pinion 22 is positioned on a mandrel 40, as shown in FIG. 3. The mandrel 40 has a tapered end 44 conforming to the tapered end of the shaft 16 and is intended to support the pinion 22 in a like manner. The pinion 22 is forced onto the mandrel 40 using a nut 42 threadably received on a threaded end 46 of the mandrel 40. The pinion 22 is forced onto the mandrel 40 in such a manner that the pinion first conforms to the configuration of the mandrel 40, and as the pinion is further forced onto the tapered end 44 of the mandrel, a tensile stress is induced in the pinion 22, the applied tensile stress preferably being at least as great as the tensile stress applied when the pinion 22 is forced onto the shaft 16 during assembly. The pinion 22 is then shot-peened using conventional shot-peening apparatus 48, shown schematically, to relieve the tensile stress in the surface of the pinion and to thereafter further produce a residual compressive stress in the surface of the pinion 22. During the shot-peening process, the impact of the shot against the surface of the pinion 22 functions to cause a thin surface layer of the metal of the pinion 22 to be elastically deformed and to tend to expand in surface area. Such expansion is resisted, however, by the remainder of the material of the pinion 22 beneath the surface layer. Accordingly, compressive stress is developed in the surface layer of the pinion 22.

Applying an initial tensile stress on the pinion 22 by forcing the pinion onto the tapered mandrel causes the circumference of the pinion to expand slightly such that during the shot-peening additional deformation or expansion of the surface layer of the metal of the pinion 22 is permitted. Following the shot-peening process, the pinion 22 is removed from the mandrel 40 such that the tensile stress on the pinion is relieved and the circumference of the pinion contracts slightly. When the pinion 22 thus contracts radially, as a result of removal of the tensile stresses, an additional compressive stress is produced in the surface of the pinion. Unless the compressive stress generated in the surface of the pinion 22 is greater than the compressive yield strength of the material of the pinion 22, the resultant residual compressive stress in the pinion is greater than the compressive stress generated in the surface of the pinion by the shot-peening alone, and the increase in the residual compressive stress so achieved is proportional to the tensile stress applied to the pinion during the shot-peening process.

The range of variation in the practice of shot-peening according to the present invention is great because of the wide variety of materials, dimensions and conditions. Consequently, it is impossible to enumerate every variation. However, the practice of the method of the invention can be guided by reference to the following specific example.

A pinion 22 of an outboard motor gearcase was forced onto a tapered mandrel 40, as shown in FIG. 3, using a nut 42 threadably positioned on the threaded end 46 of the mandrel 40 to force the pinion onto the mandrel 40. A torque of 60 foot pounds was applied to the nut. The resulting tensile stress in the material of the pinion adjacent its inside diameter was measured to be 28,000 psi. The workpiece was shot-peened in accordance with a conventional method set forth in the SAE Manual on Shot-Peening, SP-84 using S-230H shot at 0.012A to 0.016A intensity on a normal Almen test strip. The pinion was subjected to 200 percent shot-peening coverage such that every portion of the surface of the pinion was contacted by shot particles at least twice.

The pinion so processed had greater resistance to fatigue failure than similar pinions which were not shot-peened as well as those which were shot-peened but were not subjected to tensile stress while being shot-peened.

While the pinion 22 could be shot-peened in the manner described above while mounted on the drive shaft 16 rather than on the mandrel 40, production assembly methods normally require that the drive shaft 16 be connected to the engine 14 before the pinion 22 is positioned on the end of drive shaft 16, and shot-peening of the pinion 22 after positioning it on the drive shaft 16 would complicate manufacturing methods.

While the preferred procedures in the practice of the method have been indicated by the example set forth above, it should be understood that the invention is not limited to the example but rather falls within the scope of the appended claims. For example, though the process of the invention was illustrated as a method for improving the fatigue strength of a gear, the method could also be practiced with a variety of other types of workpieces.

Various of the features of the invention are set forth in the following claims.

What is claimed is:

1. A process of compression stressing a metal workpiece having a body with a central bore so as to produce a residual compressive stress in the workpiece to increase the fatigue strength of the workpiece, said process comprising the steps of forcing the workpiece onto a mandrel to induce an initial tensile stress in the body, and thereafter inducing a compressive stress in the workpiece by shot blast treatment of the surface of the workpiece, and thereafter separating the workpiece from the mandrel to increase the compressive stress in the workpiece.

2. A process of compression stressing a metal workpiece having a body with a central bore and wherein the body is intended to be subjected to a tensile stress when the workpiece is employed, the process being intended to produce a residual compressive stress in the workpiece to increase the fatigue life of the workpiece, said process comprising the steps of forcing the workpiece onto a mandrel and thereby inducing a tensile stress in the body at least as great as the tensile stress induced in the body when the workpiece is employed, and thereafter inducing a compressive stress in the workpiece by shot-peening of the surface of the workpiece, and thereafter removing the workpiece from the mandrel to increase the compressive stress in the workpiece.

3. A method of compression stressing a gear including a circumferential body having a central bore and peripheral circumferentially spaced gear teeth to produce a residual compressive stress in the body of the gear to increase the fatigue strength of the gear, said method including the steps of forcing the gear onto a tapered circular mandrel so that the bore of the gear is made circular and a tensile force is applied to the circumferential body of the gear, and thereafter shot-peening the surface of the gear to induce a compressive stress therein and thereafter removing the gear from the tapered mandrel so as to relieve the tensile force on the gear and so as to produce a residual compressive stress in the workpiece greater than the compressive stress induced by the shot blast treatment and by an amount proportional to the initial tensile stress.

4. The method set forth in claim 3 wherein the gear is intended to be subjected to tensile stress in use and wherein said step of forcing the gear onto the tapered mandrel is sufficient to produce a tensile stress in the gear at least as great as the tensile stress in the gear in use.

5. A method as set forth in claim 3 wherein the tapered mandrel is provided with a threaded end, and further including the step of positioning a nut on the mandrel and rotating the nut to force the gear onto the mandrel.

* * * * *